United States Patent [19]

Orioka et al.

[11] Patent Number: 4,754,150

[45] Date of Patent: Jun. 28, 1988

[54] PHOTOELECTRIC SMOKE DETECTOR

[75] Inventors: Yoshiharu Orioka; Mikio Mochizuki, both of Tokyo, Japan

[73] Assignee: Nohmi Bosai Kogyo Co. Ltd., Tokyo, Japan

[21] Appl. No.: 768,645

[22] Filed: Aug. 23, 1985

[30] Foreign Application Priority Data

Aug. 23, 1984 [JP] Japan ..... 59-174043

[51] Int. Cl.[4] ..... G08B 17/10

[52] U.S. Cl. ..... 250/574; 340/630; 356/339; 356/338

[58] Field of Search ..... 250/574; 356/338, 339, 356/340, 343; 340/630

[56] References Cited

U.S. PATENT DOCUMENTS

| | | | |
|---|---|---|---|
| Re. 32,105 | 4/1986 | Enemark | 340/630 |
| 3,431,423 | 3/1969 | Keller | 250/574 |
| 3,708,675 | 1/1973 | Tashiro et al. | 250/218 |
| 4,216,377 | 8/1980 | Hasegawa et al. | 250/574 |
| 4,469,953 | 9/1984 | Fujisawa et al. | 250/574 |
| 4,596,465 | 6/1986 | Nagashima | 250/574 |

FOREIGN PATENT DOCUMENTS

| | | | |
|---|---|---|---|
| 1798135 | 10/1959 | Fed. Rep. of Germany . | |
| 2758517 | 7/1978 | Fed. Rep. of Germany . | |
| 3008183 | 9/1980 | Fed. Rep. of Germany . | |
| 0029696 | 3/1978 | Japan | 340/630 |
| 0036785 | 3/1980 | Japan | 250/574 |
| 1129402 | 10/1968 | United Kingdom . | |

OTHER PUBLICATIONS

Patent Abstracts of Japan, vol. 6, No. 112, Jun. 23, 1982.

*Primary Examiner*—Edward P. Westin
*Assistant Examiner*—Charles Wieland
*Attorney, Agent, or Firm*—Werner W. Kleeman

[57] ABSTRACT

A photoelectric smoke detector is equipped with a light emitter for radiating light into a measuring space. A light receiver detects scattered light caused by the presence of smoke in the measuring space. The measuring chamber is constructed as a light trap such that the light beam radiated by the light emitter is multiply reflected and cannot reach the light receiving element of the light receiver.

5 Claims, 4 Drawing Sheets

FIG.1a
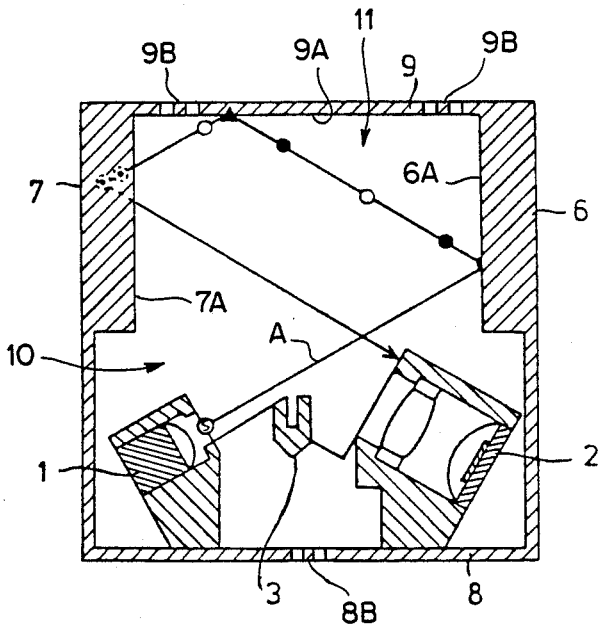
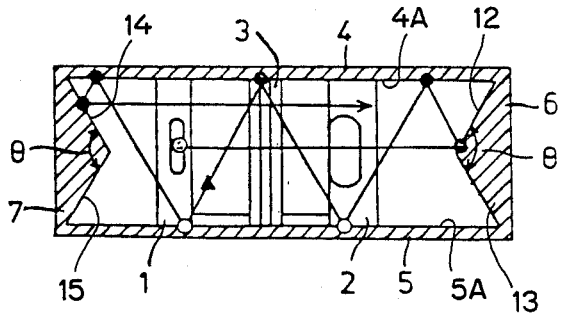
FIG.1b

FIG. 2a
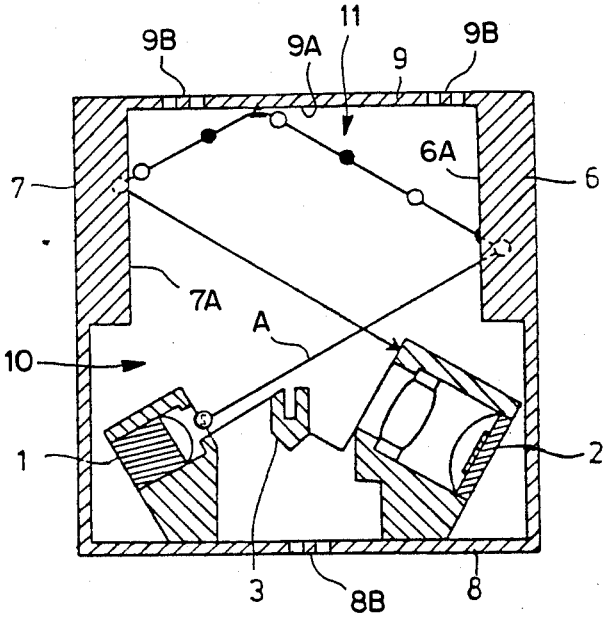
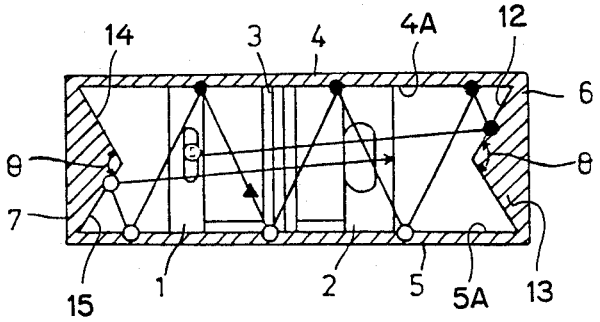
FIG. 2b

FIG.3a
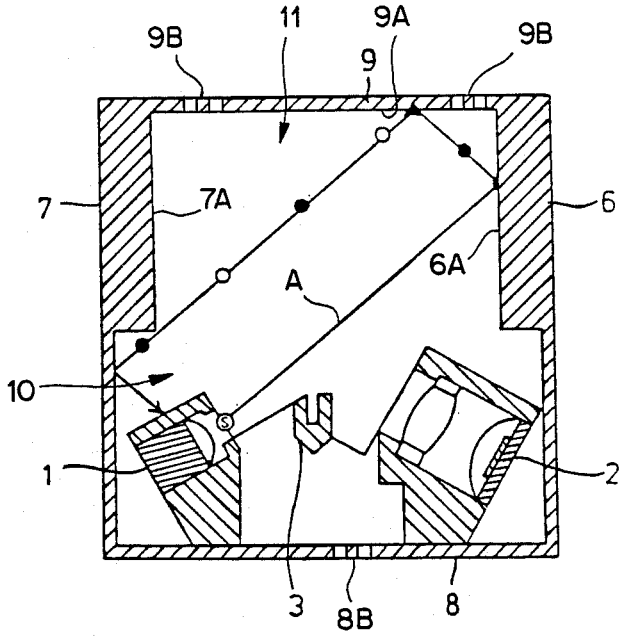
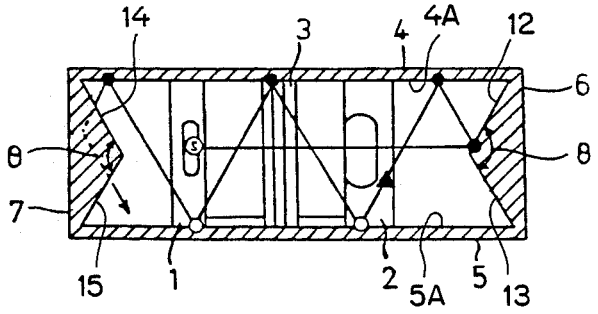
FIG.3b

FIG.4
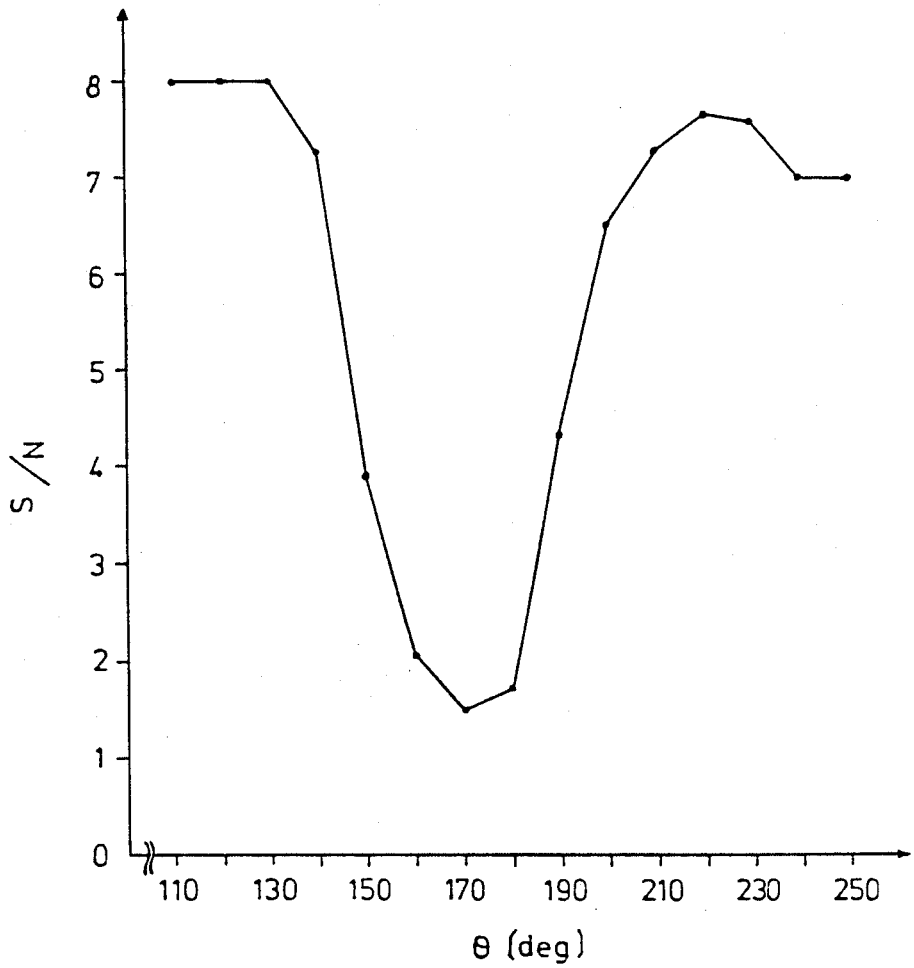
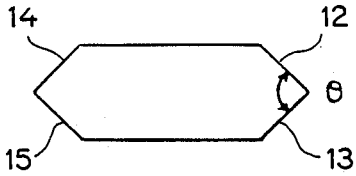
FIG.5
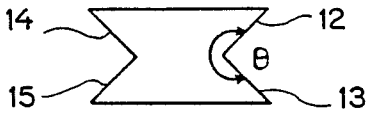
FIG.6

PHOTOELECTRIC SMOKE DETECTOR

CROSS REFERENCE TO RELATED CASES

This application is related to the commonly assigned copending U.S. application Ser. No. 06/768,647, filed Aug. 23, 1985, entitled "PHOTOELECTRIC SMOKE DETECTOR", and listing as the inventors: YOSHIHARU ORIOKA and MIKIO MOCHIZUKI and to the commonly assigned, copending U.S. application Ser. No. 06/768,646, filed Aug. 23, 1985, entitled: "PHOTOELECTRIC SMOKE DETECTOR", and listing as the inventors: YOSHIHARU ORIOKA and MIKIO MOCHIZUKI.

BACKGROUND OF THE INVENTION

The present invention broadly relates to a photoelectric smoke detector and, more specifically, pertains to a new and improved construction of a small-size or miniature photoelectric smoke detector.

In its more particular aspects, the present invention specifically relates to a new and improved construction of a photoelectric smoke detector which is equipped with a light emitter for radiating light into a measuring space and a light receiver for detecting scattered light caused by the entry or presence of smoke in the measuring space.

Dark chambers of conventional photoelectric smoke detectors have a complicated labyrinth construction or double covers to prevent the environmental light from entering the dark chamber but to facilitate entry of smoke into the same, see, for example, U.S. Pat. No. 4,596,465, granted June 24, 1986, and U.S. Pat. No. 4,216,377, granted Aug. 5, 1980.

However, such photoelectric smoke detectors with the above-mentioned dark chamber construction, being large in size, are not suitable for use as photoelectric smoke detectors to be built-in into equipment such as electronic computers or to be installed in lavatories in aircraft. These photoelectric smoke detectors also have the disadvantage that miniaturization thereof by merely reducing the size of their dark chambers results in lowering the SN ratio.

SUMMARY OF THE INVENTION

Therefore, with the foregoing in mind, it is a primary object of the present invention to provide a new and improved construction of a photoelectric smoke detector which does not exhibit the aforementioned drawbacks and shortcomings of the prior art constructions.

An important and more specific object of the present invention is directed to the provision of a new and improved construction of a photoelectric smoke detector which, although being of a small-sized construction, possesses a favorable signal-to-noise ratio for smoke detection.

Yet a further significant object of the present invention aims at providing a new and improved construction of a photoelectric smoke detector which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the photoelectric smoke detector of the present development is manifested by the features that, a dark chamber forming the measuring space comprises at least one wall comprising planar or curved surfaces arranged substantially in front of the light emitter for reflecting the light radiated from the light emitter at a predetermined angle to the optical axis of the light emitter. The dark chamber also possesses side walls arranged substantially parallel to the optical axis defined by the light emitter.

The photoelectric smoke detector according to the present invention is equipped with a dark chamber of the aforesaid construction such that the dark chamber itself is capable of performing a light trap function. More specifically, the dark chamber is designed in such a way that the light beam radiated by the light emitter is reflected from the wall surfaces of the dark chamber several times without allowing the initially reflected light to reach the light receiving element of the light receiver. The reflected light, if any, reaching the light receiver or receiving element is attenuated to a very weak intensity. Therefore it is not necessary to specially provide a light trap means. Thus a small-sized photoelectric smoke detector with a narrow measuring space is obtained.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIGS. 1*a* and 1*b* respectively show a cross-section and a transverse section through a first exemplary embodiment of the inventive photoelectric smoke detector;

FIGS. 2*a* and 2*b* respectively show a cross-section and a transverse section through a second exemplary embodiment of the inventive photoelectric smoke detector;

FIGS. 3*a* and 3*b* respectively show a cross-section and a transverse section through a third exemplary embodiment of the inventive photoelectric smoke detector;

FIG. 4 is a graphical representation of the signal-to-noise ratio S/N of the photoelectric smoke detector according to the present invention as a function of the angle $\theta$ formed between two adjacent side surfaces of both a front wall and a rear wall of the dark chamber in the inventive photoelectric smoke detector as shown in FIGS. 1*b*, 2*b* and 3*b*; and FIGS. 5 and 6 illustrate two different angles $\theta$ formed between the two adjacent side surfaces of both the front wall and the rear wall of the dark chamber in the inventive photoelectric smoke detector as shown in FIGS. 1*b*, 2*b* and 3*b*.

DETAILED DESCRIPTION OF THE PREFERRED EMBODIMENTS

Describing now the drawings, it is to be understood that to simplify the showing thereof only enough of the structure of the photoelectric smoke detector has been illustrated therein as is needed to enable one skilled in the art to readily understand the underlying principles and concepts of this invention. Turning now specifically to FIGS. 1*a* and 1*b* of the drawings, the photoelectric smoke detector illustrated therein by way of example and not limitation, will be seen to comprise a light emitter 1 which is equipped with a not particularly referenced light source such as a light emitting diode and a lens. The light emitter 1 radiates a substantially convergent light beam along a predetermined optical axis A.

A light receiver 2 also situated within the photoelectric smoke detector comprises a not particularly referenced light receiving element such as a solar cell and a lens. Furthermore, a light shielding plate 3 is provided between the light emitter 1 and the light receiver 2.

A measuring space 10 constitutes a dark chamber 11 and is bounded by a front wall 6, a rear wall 7, a bottom wall 8, a top wall 9 and two opposite side walls 4 and 5 arranged substantially parallel to the optical axis A of the light beam radiated from the light source of the light emitter 1. The front wall 6 possesses a planar or curved reflective surface 6A and is arranged substantially opposite to the light emitter 1 in order to reflect the radiated light at a predetermined angle to the optical axis A of the light beam radiated by the light source of the light emitter 1. The rear wall 7 possesses a planar or curved reflective surface 7A and is arranged substantially to the rear of the light emitter 1 to reflect the light reflected from the reflective surfaces 4A and 5A of the side walls 4 and 5 at a predetermined angle such that the reflected light does not directly irradiate the light receiving element of the light receiver 2. The bottom wall 8 and the top wall 9 possess respective apertures 8B and 9B through which smoke can enter. The aperture 8B is provided substantially in the center of the bottom wall 8. The apertures 9B are located close to associated ends of the top wall 9.

The respective reflective surfaces 4A, 5A, 6A, 7A and 9A of the side walls 4 and 5, the front wall 6, the rear wall 7 and the top wall 9 bound the dark chamber 11 constituted by the measuring space 10 and have substantially high light absorption factors or characteristics, for example, are of black color and possess a substantially mirror-like finish.

As shown in FIGS. 1*a* and 1*b*, the light beam emitted by the light source of the light emitter 1 is emitted at a starting point s. A location at the outer housing of the light receiver 2 impinged upon by the multiply reflected light beam is indicated by an arrowhead. Reflection points on the side wall 4 are represented by black dots whereas reflection points on the side wall 5 are represented by white dots. A reflection point on the top wall 9 is represented by a small triangle.

In the first exemplary embodiment of the inventive photoelectric smoke detector as illustrated in FIGS. 1*a* and 1*b*, the optical axis A of the light beam emitted or radiated by the light source of the light emitter 1 propagates in a direction which extends slightly to the left of the outer housing of the light receiver 2. The respective reflective surfaces 6A and 7A of the front wall 6 and the rear wall 7 are each formed by respective two adjacent side surfaces 12, 13 and 14, 15 enclosing an angle $\theta$ which amounts to substantially 150°.

FIGS. 2*a* and 2*b* illustrate a second exemplary embodiment of the inventive photoelectric smoke detector in which the optical axis A of the light beam emitted or radiated by the light source of the light emitter 1 propagates in a direction which, when viewed in the direction of the emitted light beam, extends slightly to the left and at an angle of 5° with respect to the light receiver 2. The angle $\theta$ between the respective two adjacent side surfaces 12, 13 and 14, 15 of the front wall 6 and the rear wall 7 again amounts to substantially 150°.

FIGS. 3*a* and 3*b* illustrate a third exemplary embodiment of the inventive photoelectric smoke detector in which the optical axis A of the light beam emitted or radiated by the light source of the light emitter 1 propagates in a direction which extends slightly to the left or, when viewed in the direction of the emitted light beam, is oriented further upward towards the top wall 9 as compared to the optical axis A of the light beam emitted or radiated by the light source of the light emitter 1 shown in FIGS. 2*a* and 2*b*.

The operation of the inventive photoelectric smoke detector containing the dark chamber 11 as described hereinbefore, is explained as follows:

As shown in FIGS. 1*a* and 1*b*, for example, the light radiated or emitted by the light source of the light emitter 1 impinges on the left side surface 12 of the front wall 6 and is reflected to and from the left-hand side wall 4, thereafter from the right-hand and the left-hand side walls 5 and 4, from the top wall 9, the right-hand side wall 5, the left-hand side wall 4, the left-hand side surface 14 of the rear wall 7, and then impinges upon the outer housing of the light receiver 2 at the point indicated by the arrowhead. In this manner, the dark chamber 11 acts as a light trap in which the light radiated from the light source of the light emitter 1 is attenuated while being reflected several times from the side walls 4 and 5 and finally possesses a very low light intensity.

In the second exemplary embodiment of the inventive photoelectric smoke detector as shown in FIGS. 2*a* and 2*b*, the light radiated from the light source of the light emitter 1 is first reflected from the left side surface 12 of the front wall 6. Further reflections of this light occur at the left-hand side wall 4, the right-hand side wall 5, the left-hand and right-hand side walls 4 and 5, the top wall 9, the left-hand side wall 4, the right-hand side wall 5, and the right-hand side surface 15 of the rear wall 7. Thereafter the reflected light impinges upon the outer housing of the light receiver 2 at the point indicated by an arrowhead.

In the third exemplary embodiment of the inventive photoelectric smoke detector as shown in FIGS. 3*a* and 3*b*, the light radiated from the light source of the light emitter 1 is first reflected from the left side surface 12 of the front wall 6. Thereafter this light is reflected from the left-hand side wall 4, the top wall 9, then the right-hand side wall 5, the left-hand side wall 4, the right-hand side wall 5, the left-hand side wall 4, and the left side surface 14 of the rear wall 7. This reflected light then impinges upon the outer housing of the light emitter 1 at the point indicated by the arrowhead and is attenuated to a very low light intensity.

On the other hand, if a fire breaks out and smoke enters the dark chamber 11, scattered light irradiates the light receiving element of the light receiver 2. This light receiver then generates an output signal which is used for activating a fire alarm.

FIG. 4 is a graphical representation of the signal-to-noise ratio S/N of the dark chamber 11 of the inventive photoelectric smoke detector. S represents the output signal of the light receiving element of the light receiver 2 when a predetermined density of smoke which is indicative of a possible fire, is present in the dark chamber 11. N represents the noise output signal of the light receiving element of the light receiver 2 in a normal condition when no smoke is present in the dark chamber 11. The angle $\theta$ represents the angle formed between the respective two adjacent side surfaces 12, 13 and 14, 15 of the front wall 6 and the rear wall 7. From FIG. 4 it will be seen that a S/N ratio which is sufficient for practical use, is obtained when the angle $\theta$ is smaller than 140° and greater than 210°.

FIGS. 5 and 6 are illustrations of the angle $\theta$ formed between the two adjacent side surfaces 12 and 13 of both the front wall 6 and the rear wall 7 showing how these angles are defined and measured with respect to the aforesaid two adjacent side surfaces.

While there are shown and described present preferred embodiments of the invention, it is to be distinctly understood that the invention is not limited thereto, but may be otherwise variously embodied and practiced within the scope of the following claims. Accordingly,

We claim:

1. A photoelectric smoke detector, comprising:

a front wall, two opposite side walls, a rear wall, a top wall and a bottom wall bounding a measuring space;

a light emitter for radiating light into said measuring space along a predetermined optical axis;

a light receiver for detecting scattered light scattered in the presence of smoke from the light radiated into said measuring space;

at least said front wall and said two opposite side walls possessing reflective surfaces facing said measuring space;

said front wall being arranged substantially opposite to said light emitter for receiving said light radiated by said light emitter and reflecting said received light at a substantially perpendicular angle relative to a plane formed by said predetermined optical axis of said light emitter and the optical axis of said light receiver;

said two opposite side walls being arranged substantially parallel to said predetermined optical axis;

said reflective surfaces of said front wall and said two opposite side walls constituting light trap means for said light radiated from said light emitter and which light trap means multiply reflect said light through said measuring space; and said light receiver being arranged outside the path of said multiply reflected light.

2. The photoelectric smoke detector as defined in claim 1, wherein:

said front wall possesses two adjacent substantially planar side surfaces forming between themselves a predetermined angle and constituting said reflective surface facing said measuring space.

3. The photoelectric smoke detector as defined in claim 2, wherein:

said tow adjacent side surfaces of said front wall form between themselves an angle which is smaller than 140° and greater than 210°.

4. The photoelectric smoke detector as defined in claim 1, wherein:

said light emitter for radiating light into said measuring space along said predetermined optical axis, emits a convergent light beam.

5. The photoelectric smoke detector as defined in claim 1, wherein:

said light receiver is placed outside said predetermined optical axis along which said light is radiated by said emitter.

* * * * *